US006419715B1

(12) United States Patent
Jones et al.

(10) Patent No.: US 6,419,715 B1
(45) **Date of Patent: *Jul. 16, 2002**

(54) DIESEL FUEL ADDITIVE COMPOSITION AND METHOD FOR THE TREATMENT OF DIESEL FUELS

(75) Inventors: Edward T. Jones, Sturgeon Bay; Richard Fisher, Milwaukee; Lewis Herro, Grafton, all of WI (US)

(73) Assignee: American Energy Group, Inc., Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/377,121

(22) Filed: Aug. 19, 1999

Related U.S. Application Data

(63) Continuation-in-part of application No. 09/156,420, filed on Sep. 18, 1998, now Pat. No. 6,183,525.

(51) Int. Cl.[7] ..... C10L 1/18
(52) U.S. Cl. ..... 44/443; 44/447; 44/450
(58) Field of Search ..... 44/443, 447, 450

(56) References Cited

U.S. PATENT DOCUMENTS 4,565,547 A * 1/1986 Takada ..... 44/439
6,183,525 B1 * 2/2001 Jones ..... 44/443

* cited by examiner

*Primary Examiner*—Cephia D. Toomer
(74) *Attorney, Agent, or Firm*—Keith V. Rockey

(57) ABSTRACT

A fuel additive for use in the treatment of diesel fuels to reduce polluting emissions during the combustion of such fuels wherein the additive composition is formulated to contain mineral seal oil, mineral spirits, a glycol alkyl ether and at least one alkyl aromatic ethoxylated surfactant. It has been found that the fuel additive composition of the invention can be blended with such fuels to dramatically reduce emissions during the combustion of such fuels.

12 Claims, No Drawings

DIESEL FUEL ADDITIVE COMPOSITION AND METHOD FOR THE TREATMENT OF DIESEL FUELS

CROSS-REFERENCE TO RELATED APPLICATIONS

This is a continuation-in-part of application Ser. No. 09/156,420, filed Sep. 18, 1998, now U.S. Pat. No. 6,183,525.

This invention is addressed to the treatment of diesel fuels, and more particularly to the treatment of diesel fuels to render such fuels cleaner burning to control emissions and to improve combustion efficiency thereby increasing mileage.

BACKGROUND OF THE INVENTION

The control of emissions from internal combustion engines has received substantially continuous attention for many years in attempts to reduce emissions of carbon monoxide, nitrogen oxides (NOX), unburned hydrocarbons and others from the combustion of such fuels. The control of pollution has received worldwide attention as attempts are made to fashion fuel additives that have the capability of making such liquid hydrocarbon fuels cleaner burning. Various approaches have been taken in the prior art in attempts to formulate additives that reduce the pollution generated by such fuels, but generally have met with limited success.

For example, it has been proposed to employ various alkyl ethers for the purpose of controlling pollution generated by gasoline fuels. Such attempts are described in U.S. Pat. Nos. 2,089,580, 2,104,021, 2,221,839, 2,563,101, 2,786,745, 2,930,681, 3,032,971, 3,103,101, 3,270,497, and 5,425,790, as representative. As described in those patents, it is frequently the practice to employ such ethers either alone or in combination with alcohol to provide improved performance characteristics in a variety of liquid hydrocarbon fuels.

Attempts have likewise been made to clean up such fuels by incorporating in the fuel as an additive various aromatic detergents containing one or more aromatic rings and bonded thereto various alkylene oxide groups in an effort to reduce hydrocarbon emissions. Such an approach is described in U.S. Pat. Nos. 3,328,284 and 3,615,295. The prior art has likewise proposed various combinations of additives to clean fuel systems. One such example is U.S. Pat. No. 3,658,494, describing a combination of oxy compounds in the form of monoethers of glycols and polyglycols in combination with dispersants derived from high molecular weight carboxylic acids, and particularly their esters, amides, imides, amidines and amine salts. U.S. Pat. No. 4,384,872 describes a fuel additive formulated of a lower alkanol combination with a surfactant to provide increased water tolerance in such fuel compositions. Similar approaches are described in U.S. Pat. No. 4,516,981, teaching an oil sludge dispersant formulated of an alcohol, a glycol ether and a poly ethoxylated phenol. And U.S. Pat. No. 4,877,416 teaching a combination of a hydrocarbon substituted amine or polyamine and a poly (oxy alkylene) monool.

Attempts have also been made to use oxidizing agents in combination with glycols and glycol ethers. One such example is described in U.S. Pat. No. 5,314,511, describing the combination of an organic peroxide in combination with a lower alkylene glycol ether to reduce emissions. U.S. Pat. No. 5,409,507 describes a fuel additive which is formulated of a nitro, amino or N-alkylamino-substituted poly (oxyalkylene) aromatic ethers in combination with antioxidants, metal deactivators, demulsifiers and like known additives. U.S. Pat. No. 5,782,936 describes a fuel additive for liquified petroleum gases or LPG containing a petroleum fraction methanol and an ethoxylated alkyl phenol.

Notwithstanding all of the efforts in the area of improving the performance of such fuels from a standpoint of pollution control, no product has been, up to the present, capable of satisfying rigorous pollution standards presently in effect or contemplated. Thus, there is a need to provide a fuel additive composition which has the capability of significantly reducing pollution from such liquified hydrocarbon fuels.

In copending application Ser. No. 09/156,420, filed Sep. 18, 1998 (U.S. Pat. No. 6,183,525), there is disclosed a fuel additive composition which has been employed in the treatment of a number of hydrocarbon fuels such as gasoline which has been found to represent an advance in the art. That composition, utilizing a combination of components, has been found to effectively control hydrocarbon emissions from a broad range of hydrocarbon fuels. It has now been found that the same composition can be effectively used in the treatment of diesel fuels with even greater efficiency than it provides when employed in the treatment of, for example, gasoline. That result was quite unexpected in light of the fact that diesel engines are notoriously more prone to generate pollution in the form of hydrocarbon and NOX emissions as compared to, for example, gasoline engines. Diesel fuel, because it typically contains predominantly $C_{10}$ to $C_{30}$ or higher hydrocarbons, has a markedly reduced volatility as compared to gasolines, and is more prone to water contamination. It was therefore quite unexpected that the additive composition disclosed and claimed in the foregoing copending application has even greater effectiveness in controlling and minimizing pollution generated by diesel engines.

It is accordingly an object of the present invention to provide a fuel additive composition which overcomes the foregoing disadvantage.

It is another object of the invention to provide a method for the treatment of diesel which has the capability of significantly lowering the pollution characteristics of such fuels when used in internal combustion engines.

It is a more specific object of the present invention to provide a fuel additive composition which can be added to diesel fuels to promote cleaner, more efficient combustion thereof in internal combustion engines.

It is another related object of the-invention to provide a method for the treatment of diesel fuels with a fuel additive composition whereby the pollution emitted by the treated fuel is substantially reduced.

It is another object of the invention to provide an improved diesel fuel composition containing the fuel additive of the invention which has the capability of serving as a fuel in diesel engines which provides substantially reduced emissions.

These and other objects and advantages of the invention will appear more fully hereinafter by way of the following description of the invention.

SUMMARY OF THE INVENTION

The concepts of the present invention reside in a novel fuel additive composition which is not only simple and inexpensive to manufacture, but also has the capability of enhancing the performance characteristics of diesel fuels such that the treated diesel fuels, when consumed in an internal combustion engine, burn far more efficiently with substantially less emissions. It has been found that the treated fuel according to the present invention provides not only greater fuel mileage but also provides increase horsepower realization. In accordance with the concepts of the invention, the fuel additive composition is formulated with a novel combination of components which function together to significantly reduce hydrocarbon emissions in the burning of diesel fuel to which the additive has been combined in internal combustion engines.

The fuel additive composition of the present invention is formulated to contain mineral seal oil, an alkylene glycol ether and at least one liquid nonionic surfactant. Optionally, the composition may also be formulated to include hydrocarbon dileants, and preferably mineral spirits. The precise manner in which the foregoing components function in combination with each other is not fully understood at the present time. Without limiting the invention as to theory, however, it is believed that the mineral seal oil serves to provide upper cylinder lubrication as part of the combustion process. The mineral spirits, when present, appear to improve oxidation efficiency of the fuel with which the additive is combined and the glycol ether in combination with the surfactant appears to disperse water contained within the fuel system containing the additive so as not to interfere with the complete combustion of the treated fuel. Tests have shown that diesel fuel which has been treated with the fuel additive of the present invention can virtually immediately cause internal combustion engines to meet, and sometimes exceed, current pollution standards.

In accordance with another concept of the invention, the present invention is also directed to a method of treatment of diesel fuels with the fuel additive. In accordance with the method of the invention, the fuel additive composition is added to a liquid hydrocarbon fuel, which can then be burned in a diesel engine. The treatment of the diesel fuel with the fuel additive composition has been found to dramatically decrease the emissions given off during combustion.

DETAILED DESCRIPTION OF THE INVENTION

The fuel additive composition of the present invention is formulated to include, as one component thereof, mineral seal oil. The term "mineral seal oil" as used herein is well understood by those skilled in the art as referring to well-known lubricating oils, mineral oils and high boiling petroleum distillates having a boiling point above 250° C., and preferably within the range of 270° C. to 370° C. Such oils are well known to those skilled in the art, and are described in detail in U.S. Pat. No. 4,443,348, the disclosure of which is incorporated herein by reference. As indicated above and without limiting the invention as to theory, it is believed that the mineral seal oil serves to provide upper cylinder lubrication and controlled oxidation when a fuel containing the fuel additive composition of the present invention is consumed in a diesel engine.

Another component which may be optionally employed in the formulation of the fuel additive composition of the present invention is referred to as mineral spirits, another well understood term as described in U.S. Pat. No. 4,443,348. The term "mineral spirits" covers low boiling petroleum fractions boiling at a temperature of at least 150° C. and preferably a temperature within the range of about 150° C. to about 400° C. Again, without limiting the invention as to theory, it is believed that the mineral spirits component of the fuel treatment composition of the present invention serves at least in part to control the combustion of the diesel fuel with which the additive is combined.

Another component used in the practice of the present invention is an alkylene glycol ether, including both ethylene glycol ethers and propylene glycol ethers. The alkylene glycol alkyl ether has the formulation $$HO—CH_2—CH_2—OR_5$$

wherein $R_5$ is an alkyl group containing 3 to 6 carbon atoms. Preferred for use in the practice of the present invention are those ethers having the following structural formula:

$$R_1—O—[CH_2—CH_2-(CH_2)_x]_n—O—R_2$$

wherein $R_1$ is an alkyl group containing 2 to 6 carbon atoms (e.g., propyl, butyl, isobutyl, pentyl and hexyl groups), $R_2$ is hydrogen or an alkyl group containing 2 to 6 carbon atoms, x is 0 or 1 and n is an integer from 1 to 3. A variety of ethers can be employed in the practice of the invention, including ethylene glycol propyl ether, propylene glycol monoethyl ether, ethylene glycol butyl ethyl ether and the like. The preferred ether employed in the practice of the present invention is ethylene glycol monobutyl ether.

The fuel additive composition of the present invention is likewise formulated to include at least one liquid nonionic surfactant. Preferred surfactants are selected from the group consisting of ethoxylated alcohol surfactants and oxygenated substituted aromatic surfactants. In the former group, ethoxylated alcohols are derived from $C_5$ to $C_{18}$ alcohols containing 1 to 10 ethoxylated groups attached thereto. For example, use can be made of ethoxylated decyl alcohols as surfactants. In the latter group, use can be made of oxygenated substituted phenolic compounds containing 12 to 30 carbon atoms per molecule.

Again, without limiting the invention as to theory, it is believed that the surfactant and the ether (acting as a coupling agent) cooperate each with the other to minimize the effects of water contained in the diesel fuel during the combustion process. In the preferred practice of the present invention, the surfactant is at least one compound having the formula:

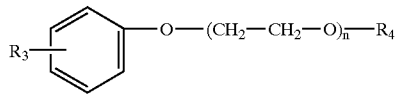

wherein $R_3$ is a long chain alkyl group, and preferably one containing 6 to 12 carbon atoms (e.g., heptyl, octyl, nonyl, decyl, etc.). $R_4$ is selected from the group consisting of hydrogen and lower alkyl (e.g., methyl, ethyl, propyl) and n is an integer averaging from 2 to 40 preferably 2 to 12. It is frequently preferred, in the practice of the present invention, to use combinations of the foregoing surfactants. For example, it is possible and sometimes desirable to employ an ethoxylate wherein $R_4$ is lower alkyl and/or an ethoxylated compound where $R_4$ is hydrogen. Such surfactants are commercially available under the trademark TERGITOL and others. For example, TERGITOL NP-4 is a nonyl phenol polyethoxylate while TERGITOL NP-9 is a nonyl phenol polyethylene glycol ether. It has been found that particularly effective results are achieved in reducing hydrocarbon emissions when TERGITOL NP-4 and TERGITOL NP-9 are used in combination with each other.

The fuel additive composition of the present invention can also be formulated with other components which do not materially effect the composition. For example, it is frequently desirable to formulate the composition to contain a dye to allow workers handling the composition to distinguish between the additive composition and other petroleum products. It has been found that blue dye can be used to distinguish the additive composition where it is desired to do so.

The composition of the present invention is somewhat sensitive to variations in the amount of the various components employed. In general, the mineral seal oil generally constitutes from about 5 to about 15 parts by weight of the additive composition while the mineral spirits, when present, typically represents from about 40 to 60 parts by weight of the composition. The glycol ether should be employed in an amount within the range of about 20 to about 40 parts by weight of the composition; the total amount of the surfactant should range between about 2 and 15 parts be weight of the composition.

In general, the additive composition of the present invention is prepared by conventional techniques. In general, it is preferred that the mineral spirits be blended with the mineral seal oil for about 0.5 to 20 minutes to ensure uniform blending of those two components. Thereafter, the glycol ether is added to the composition and then the surfactant is added, followed by blending of the surfactant. When a compatible dye is used, the dye is used in an amount sufficient to provide a uniform color to the composition. Typically, a blue dye can be used in an amount within the range of about 0.1 to 5 ounces for every 300 gallons of the fuel additive composition.

The fuel additive composition of the present invention has been found to have particular utility in the treatment of diesel fuels. In the treatment of such diesel fuels, it is sufficient to blend the fuel additive with the fuel in an amount sufficient to reduce the pollution and emissions generated on combustion of the fuel to which the additive has been mixed. In general, the amount of additive employed ranges from about 0.005 to about 0.1 parts by volume of additive per part by volume of diesel fuel. As those skilled in the art will appreciate, the amount of the fuel additive employed varies to some extent with the nature and quality of the diesel fuel with which it is blended.

Having described the basic concepts of the invention, reference is now made to the following examples which are provided by way of illustration and not by way of limitation of the practice of the invention in the formulation of the fuel additive composition and its use in the treatment of liquid hydrocarbon fuels.

EXAMPLE 1

A quantity of 12 parts by weight of mineral seal oil is blended with 48 parts by weight of mineral spirits, and the resulting mixture is blended for about 5 minutes to ensure a uniform blend. Thereafter, 32 parts by weight of ethylene glycol butyl ether is added to the blend with further stirring. finally, 7 parts by weight of TERGITOL NP-9 is added and the entire mixture is blended for 10 minutes at ambient temperatures. Thus, the fuel additive has the following composition:

| | |
|---|---|
| Mineral Seal Oil | 12 parts by weight |
| Mineral Spirits | 48 parts by weight |
| Ethylene Glycol Butyl Ether | 32 parts by weight |
| TERGITOL NP-9 | 7 parts by weight |

The foregoing composition was tested with diesel fuel and was found to dramatically decrease pollutants emitted during combustion.

EXAMPLE 2

Using the procedure described in Example 1, the following composition was then prepared:

| | |
|---|---|
| Mineral Seal Oil | 10 parts by weight |
| Mineral Spirits | 50 parts by weight |
| Ethylene Glycol Butyl Ether | 30 parts by weight |
| TERGITOL NP-4 | 5 parts by weight |
| TERGITOL NP-9 | 5 parts by weight |

After the composition is prepared, a blue dye is added. When blended with diesel fuel, the fuel additive composition of the present invention is found to dramatically decrease pollutants emitted from diesel fuel.

EXAMPLE 3

Using the procedure described in Example 1, the following composition was then prepared:

| | |
|---|---|
| Mineral Seal Oil | 10 parts by weight |
| Mineral Spirits | 50 parts by weight |
| Ethylene Glycol Ethyl Butyl Ether | 30 parts by weight |
| TERGITOL NP-4 | 5 parts by weight |
| Ethoxylated lauryl alcohol | 5 parts by weight |

After the composition is prepared, a blue dye is added. When blended with diesel fuel, the fuel additive composition of the present invention is found to decrease pollutants emitted from diesel fuel.

It will be understood that various changes and modifications may be made in the details of procedure, formulation and use without departing from the spirit of the invention especially as defined in the following claims.

What is claimed:

1. A fuel additive composition for use in the treatment of diesel fuels consisting essentially of from about 5 to 15 parts by weight of mineral seal oil, from about 40 to 60 parts by weight mineral spirits, from about 20 to 40 parts by weight alkylene glycol alkyl ether and about 2 to 15 parts by weight of at least one liquid nonionic surfactant selected from the group consisting of ethoxylated alcohol surfactants and oxygenated substituted aromatic surfactants.

2. A composition as defined in claim 1 wherein the mineral seal oil is a petroleum distillate having a boiling point above 250° C.

3. A composition as defined in claim 1 wherein the mineral seal oil has a boiling point within the range of 270° C. to 370° C.

4. A composition as defined in claim 1 wherein the mineral spirits is a petroleum fraction having a boiling point within the range of about 150° C. to about 400° C.

5. A composition as defined in claim 1 wherein the alkylene glycol ether has the structural formulation:

$$R_1—O—[CH_2—CH_2-(CH_2)_x]_n—O—R_2$$

wherein $R_1$ is an alkyl group containing 2 to 6 carbon atoms, $R_2$ is hydrogen or an alkyl group containing 2 to 6 carbon atoms, x is 0 or 1 and n is an integer from 1 to 3.

6. A composition as defined in claim 1 wherein the alkylene glycol alkyl ether has the formulation:

$$HO—CH_2—CH_2—O—R_5$$

wherein $R_5$ is an alkyl group containing 3 to 6 carbon atoms.

7. A composition as defined in claim 1 wherein the oxygenated substituted aromatic surfactant has the structure:

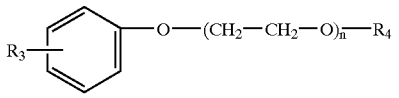

wherein $R_3$ is $C_6$ to $C_{12}$ alkyl, $R_4$ is hydrogen or $C_1$ to $C_3$ alkyl and n is an integer from 2 to 12.

8. A composition as defined in claim 1 wherein the alkyl ether is ethylene glycol mono butyl ether.

9. A composition as defined in claim 1 which includes two different oxygenated substituted aromatic surfactants.

10. A method for the treatment of diesel fuels comprising adding to such fuels a fuel additive composition as defined by claim 1.

11. A fuel composition for use in diesel engines comprising a diesel fuel and the fuel additive composition defined by claim 1 wherein the additive is present in an amount sufficient to reduce the pollution emitted during combustion of the diesel fuel.

12. A fuel additive composition for use in the treatment of diesel fuels consisting essentially of from about 5 to 15 parts by weight of mineral seal oil, from about 20 to 40 parts by weight alkylene glycol alkyl ether and about 2 to 15 parts by weight of at least one liquid nonionic surfactant selected from the group consisting of ethoxylated alcohol surfactants and oxygenated substituted aromatic surfactants.

* * * * *